US012601246B2

(12) United States Patent
Zhou et al.

(10) Patent No.: US 12,601,246 B2
(45) Date of Patent: Apr. 14, 2026

(54) METHOD AND APPLICATION OF ACIDIZING FRACTURING IN CARBONATE FORMATIONS

(71) Applicant: China University of Petroleum (Beijing), Beijing (CN)

(72) Inventors: Zhou Zhou, Beijing (CN); Yan Jin, Beijing (CN); Mian Chen, Beijing (CN)

(73) Assignee: China University of Petroleum (Beijing), Beijing (CN)

( * ) Notice: Subject to any disclaimer, the term of this patent is extended or adjusted under 35 U.S.C. 154(b) by 0 days.

(21) Appl. No.: 18/980,602

(22) Filed: Dec. 13, 2024

(65) Prior Publication Data

US 2025/0223897 A1 Jul. 10, 2025

(30) Foreign Application Priority Data

Jan. 8, 2024 (CN) ..... 202410022880.6

(51) Int. Cl.
*E21B 43/27* (2006.01)

(52) U.S. Cl.
CPC ..... *E21B 43/27* (2020.05)

(58) Field of Classification Search
CPC ..... E21B 43/27; E21B 43/26
See application file for complete search history.

(56) References Cited

U.S. PATENT DOCUMENTS 7,571,766 B2 * 8/2009 Pauls ..... E21B 43/114 166/280.1
9,390,204 B2 * 7/2016 Bowen ..... G06F 30/17

FOREIGN PATENT DOCUMENTS

CN 110656920 A 1/2020
CN 111236917 A 6/2020

* cited by examiner

*Primary Examiner* — Catherine Loikith
(74) *Attorney, Agent, or Firm* — Calfee, Halter & Griswold LLP

(57) ABSTRACT

The invention relates to the field of reservoir stimulation in oil and gas formations, and discloses an acidizing fracturing method for carbonate formations and application of the acidizing fracturing method, wherein the method comprises the following steps: (1) designing artificial fractures according to a target location in the fracture-vug formation and a wellbore structure after well completion, and apply of drilling-fracturing integration tool to drill inside rock as the artificial fractures; (2) sealing the artificial fractures with open hole packer and then fracturing it to create fracture network I; (3) injecting acid for acidizing fracturing treatment on the fracture network I to create fracture network II. The invention can artificially control the direction and the length of propagation of the artificial fracture to create complicated fracture network to connect more hydrocarbon reservoirs in fracture-vug formations. This can provide an efficient and reliable stimulation application to save time and cost.

16 Claims, 2 Drawing Sheets

METHOD AND APPLICATION OF ACIDIZING FRACTURING IN CARBONATE FORMATIONS

CROSS-REFERENCE TO RELATED APPLICATION

This application claims the benefit of Chinese patent application 202410022880.6 filed Jan. 8, 2024, the contents of which are incorporated herein by reference.

TECHNICAL FIELD

The invention relates to the reservoir stimulation of oil fields, in particular to an acidizing fracturing method for carbonate formations and application of the acidizing fracturing method.

BACKGROUND

Acidizing fracturing is an effective and necessary technology to stimulate hydrocarbon recovery in carbonate formations. During acidizing fracturing, it is very important to control the direction and azimuth of the propagation of artificial fractures to connect as many vug and caves as possible which contain oil and gas resources. Meanwhile, it is also significant and necessary to minimize the impact from competitive fractures and reservoir heterogeneity on the propagation of artificial fractures. However, there is very few methods to truly control fracture propagation because the propagation is mainly determined by geological factors which is difficult to change. Therefore, the orientation of the propagation of artificial fractures are always uncertain which definitely reduces the efficiency of stimulation.

SUMMARY OF THE INVENTION

The invention aims to overcome the lack of ability to control fracture propagation, and develops an acidizing fracturing technology in carbonate formations. This technology is able to control the orientation of the fracture propagation to connect exceeded oil and gas storages. It can also increase efficiency and reliable to save time and cost.

In order to achieve the above object, the first aspect of the invention provides a acidizing fracturing method of carbonate formations, including the steps of:

(1) designing the propagation direction and the propagation length of an artificial fracture according to a target location in the fracture-vug formation and a wellbore structure after well completion, tripping the drilling-fracturing integrated tool in the wellbore, and creating an artificial fracture through drilling in the wellbore with designed initiation location and designed propagation azimuth; along the direction of entering the well, the drilling-fracturing integrated tool is from bottom to top in proper order: the system comprises a PDC bit, a downhole motor, a flexible drilling tool, an open hole packer and a combined acidizing tubing;

(2) sealing the artificial fractures by using the open hole packer, and injecting fracturing fluid into the artificial fracture to increase pressure until initiation to create fracture network I;

(3) injecting acid for acidizing fracturing treatment on the fracture network I to create fracture network II.

The second aspect of the invention provides the use of the method of the first aspect as hereinbefore described in the field of oil and gas development.

The technical scheme provided by the invention at least has the following advantages:

(1) The technical scheme provided by the invention can artificially control the propagation direction and the propagation length of the main fracture in the fracture-vug carbonate formations, and the direction and the length of the main fracture are designed according to the hole distribution state of the target fracture-vug formation, so that the main fracture can communicate more holes and natural fractures to form a fracture network, a fracturing control area is expanded, and the fracture control area cannot be interfered by reservoir stress and existing fractures.

(2) According to the technical scheme provided by the invention, the drilling-fracturing integrated tool is adopted to artificially manufacture the main fracture, the drilling is stopped after the PDC bit drills to the design requirement of the main fracture, do not remove the PDC bit, the artificial fractures is directly sealed by using an open hole packer in the drilling-fracturing integrated tool, the pressure build-up fracture is immediately carried out, the well cementation is not needed, and the cost and the time are saved compared with the traditional methods.

(3) According to the technical scheme provided by the invention, the small-size drilling tool is preferably adopted to artificially manufacture the main fracture, so that the collapse of the wellbore can be effectively prevented, and the acidizing reconstruction is easier to perform.

(4) According to the technical scheme provided by the invention, the acid liquor is pumped into the drilling and acidizing integrated tubing by the ground equipment, reaches the water hole part of the drill bit through the tubing, finally reaches fracture network under the control of the artificial fractures, the technical scheme provided by the invention can be uniformly injected into the fractures, can be directly sprayed at the fracture tip, and has a better acid etching effect.

DESCRIPTION OF THE REFERENCE NUMERALS

Figure 1:
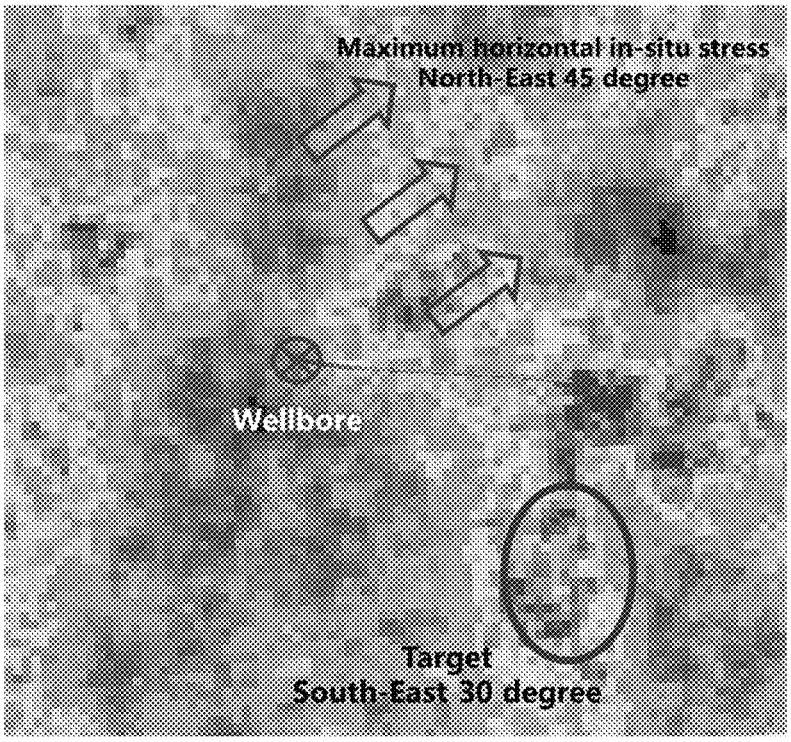
FIG. 1 is a schematic illustration of an artificial fracture design according to a preferred embodiment of the invention.

1 is a guide anchor; 2 is PDC bit; 3 is a downhole motor; 4 is a flexible drilling tool; 5 is an open hole packer; 6, a combined acidizing tubing; 7 and 10 are both wellbores; 8 and 11 are both artificial fractures; both 9 and 12 are fracture network.

DETAILED DESCRIPTION

The endpoints of the ranges and any values disclosed herein are not limited to the precise range or value, and these ranges or values should be understood to encompass values close to these ranges or values. For numerical ranges, each range between its endpoints and individual point values, and each individual point value can be combined with each other to give one or more new numerical ranges, and such numerical ranges should be construed as specifically disclosed herein.

It should be noted that, before implementing the technical scheme provided by the invention, an open hole completion needs to be performed on a target fracture-vug formation to create a wellbore, the invention has no particular limitation on the specific operation of the open hole completion, and a person skilled in the art may select to implement the method according to technical means known in the art, and the invention is not described herein in detail, and the person skilled in the art should not be construed as a limitation to the invention.

The method predicts the position of a fracture-vug formation according to seismic inversion and ant body tracking modeling technologies; measuring the development characteristics of the natural fractures by means of imaging logging, core observation and the like; a refined three-dimensional crustal stress model of the whole well periphery was established to determine the distribution and magnitude of crustal stress by adopting a regional-local-single well, first large and then small, step-by-step constraint approach. And then designing the propagation direction and the propagation length of the artificial fractures according to the geographical position characteristics of the target fracture-vug formation, the distribution characteristics of the holes and the natural fractures and the distribution and the size of the crustal stress. The purpose is to communicate as many natural fractures and holes as possible to improve production efficiency.

As previously mentioned, the first aspect of the invention provides a acidizing fracturing method of carbonate formations, including the following steps:

(1) designing the propagation direction and the propagation length of an artificial fracture according to a target location in the fracture-vug formation and a wellbore structure after well completion, tripping the drilling-fracturing integrated tool in the wellbore, and creating an artificial fracture through drilling in the wellbore with designed initiation location and designed propagation azimuth;

along the direction of entering the well, the drilling-fracturing integrated tool is from bottom to top in proper order: the system comprises a PDC bit, a downhole motor, a flexible drilling tool, an open hole packer and a combined acidizing tubing;

(2) sealing the artificial fractures by using the open hole packer, and injecting fracturing fluid into the artificial fracture to increase pressure until initiation to create fracture network I;

(3) injecting acid for acidizing fracturing treatment on the fracture network I to create fracture network II.

The PDC bit is a polycrystalline diamond compact drill bit.

Preferably, in step (1), the PDC bit has an outer diameter of 152 mm to 171.4 mm, more preferably 152 mm.

Preferably, in step (1), the downhole motor has an outer diameter of 127 mm to 139.7 mm, more preferably 127 mm. The inventor of the invention finds in research that the PDC bit under the optimal condition can effectively prevent the collapse of the wellbore, which is more conducive to subsequent fracturing and acidification transformation, forming complex fracture networks, and improving the efficiency of oil and gas energy extraction.

Preferably, in the step (1), along the direction of entering the well, the flexible drilling tool in the drilling-fracturing integrated tool sequentially comprises a measuring short section, a weighted drill pipe short section and a common drill pipe short section from bottom to top.

Preferably, the single length of the short section contained in the flexible drilling tool is 300 mm to 500 mm.

Figure 2:
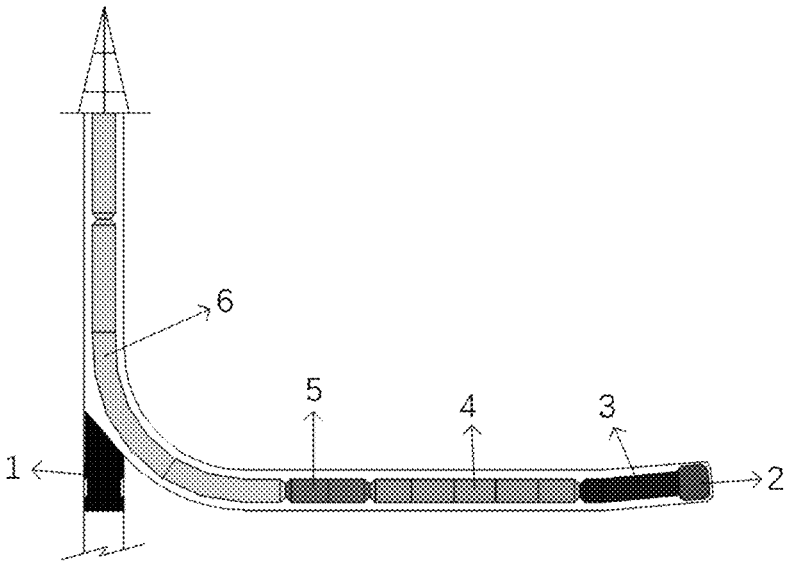
FIG. 2 is a schematic view of a drilling-fracturing integrated tool of a preferred embodiment of the invention.

In the invention, the length of the flexible drilling tool is determined according to the length of the designed artificial fractures, in FIG. 2, the black part refers to the guide anchor 1, the red part refers to the PDC bit 2, the blue part refers to the downhole motor 3, the green part refers to the flexible drilling tool 4, the rose part refers to the open hole packer 5, and the gray part refers to the combined acidizing tubing 6. As shown in FIG. 2, a drilling-fracturing integrated tool is assembled according to the designed length of the artificial fractures, a PDC bit 2, a downhole motor 3, a flexible drilling tool 4, an open hole packer 5 and a combined acidizing tubing 6 are sequentially arranged along the direction of entering the well from bottom to top, the drilling is stopped after the PDC bit drills to the design requirement of the artificial fracture, do not remove the PDC bit, the open hole packer 5 is ensured to be positioned in the newly constructed artificial fractures and close to the fracture starting position of the artificial fractures, the open hole packer 5 is activated so that the artificial fracture forms a confined space, and then the pressure formation is performed to create the fracture network I.

Preferably, in the step (1), the combined acidizing tubing is a drilling and acidizing integrated tubing, and an elastic stabilizers are connected on the combined acidizing tubing.

In the invention, the drilling-fracturing integrated tool is also connected with ground equipment, the ground equipment comprises a drilling machine, a slurry pump, a fracturing pump truck group and the like, the slurry pump is started when the artificial fractures is prepared, and a drilling fluid is adopted to drive a downhole motor to rotate at a high speed so as to break rocks and drill to form the artificial fractures. Those skilled in the art can select the required ground equipment according to the technical means known in the art, and the invention will not be described herein, and those skilled in the art should not be construed as limiting the invention.

According to a preferred embodiment, in step (1), the method further comprises: firstly, a retrievable whip stock is tripped into the well according to the well structure, the depth and the orientation of the whip stock in the well are determined according to the designed initiation position and the propagated direction of the artificial fractures, and then the drilling-fracturing integrated tool is tripped in to created artificial fractures.

Figure 3:
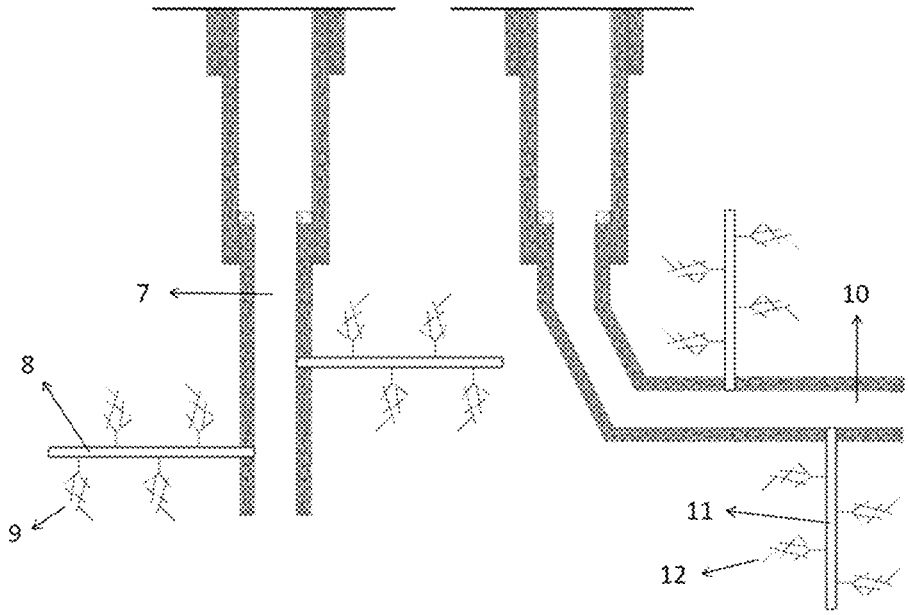
FIG. 3 is a schematic representation of the effect of a preferred embodiment of the invention.

FIG. 3 illustrates a design stratigraphic effect diagram. The related art terms described are the usual definitions or meanings understood by those skilled in the art of this invention. As shown in FIG. 3, the PDC bit of the invention needs to perform sidetrack drilling in a wellbore 7 or a wellbore 10 to obtain an artificial fracture 8 or an artificial fracture 11, and then fracture acidizing is continued on the basis of the artificial fractures to obtain a fracture network 9 or a fracture network 12. The invention preferably adopts oblique anchor mechanism technology to achieve sidetracking. According to the technical scheme provided by the invention, the windowing angle of the PDC bit can approach 90 degrees and is expanded in the direction perpendicular to the wellbore. The length of the artificial fractures can reach 70 meters, the direction is fixed, and the artificial fractures is not interfered by reservoir stress or the existing fractures.

The invention is not limited to the specific type and displacement of the fracturing fluid, and those skilled in the art can select the type of the fracturing fluid known in the art and determine the displacement of the fracturing fluid according to the actual conditions of the target fracture-vug formation, as long as the desired fracture network can be created by successful fracturing.

Preferably, in the step (2), the pressure increase to initiate fracture network so that the number fractures of fracture network I is ≥3. And after the artificial fractures is constructed, stopping the drilling-fracturing integrated tool in the fracture, sealing the tail of the fracture by using an open hole packer, injecting fracturing fluid, suppressing the pressure in the artificial fractures to initiate the fracture, and opening the natural fracture to create the fracture network I.

The number of fracturing pump truck groups required for carrying out the pressure building and fracture making in the step (2) and the pressure resistance of pipelines are not particularly limited, A person skilled in the art may make a determination based on the predicted maximum fracturing pressure, as long as the number of fracture network I can meet the requirements of the invention. So that the invention is not described herein again, and the person skilled in the art is not to be understood as limiting the invention.

Preferably, in the step (3), the osmotic flow of acid in porous media of formations by alternately injecting with the acid and the fracturing fluid.

Preferably, the number of the alternating injections is 3 to 5.

The invention has no particular limitation on the specific type and displacement of the acid solution used, and those skilled in the art can select the acid solution type known in the art and determine the displacement of the acid solution according to the actual situation of the target fracture-vug formation. The invention provides a preferred specific embodiment as an example in the following text, and those skilled in the art should not understand it as a limitation of the invention.

The injection time and the injection quantity for performing the alternate injection are not particularly limited, the injection time can be adjusted according to actual conditions, and the time of each injection can be between several minutes and several hours, which depends on factors such as the depth of a wellbore, formation conditions, operation requirements and the like. The injection quantity is determined by comprehensively considering factors such as the size of a wellbore, geological conditions, fracture design requirements and liquid properties. The injection amount should be set so that the fracturing fluid and acid can sufficiently cover and penetrate into the fracture network to achieve the desired fracturing and acidizing effect. The specific injection amount can be tested and adjusted according to actual conditions. The invention is not described in detail herein, and those skilled in the art should not be construed as limited thereto.

FIG. 3 is a schematic diagram of an effect of obtaining an artificial fracture and a fracture network by performing acidizing fracturing on a carbonate formations according to the technical scheme provided by the invention. The invention improves traditional fracturing technology by controlling the direction of main fracture propagation, enhancing the communication ability of natural fractures, and optimizing the distribution of acid solution. The invention does not need to control the PDC bit to drill in different directions. After determining the direction, it drills along a straight line to create artificial fractures without cementing. It can directly perform fracturing and acidification treatment without drilling after the drilling is completed, obtaining branch fractures, greatly shortening the engineering cycle, saving time, and improving the efficiency of fracturing.

As mentioned previously, the second aspect of the invention provides the use of the method of the first aspect described above in the field of oil and gas development.

The invention will be described in detail below by way of example. In the following example, the raw materials and equipment are all commercially available unless otherwise specified.

A PDC bit: the outer diameter is 152 mm, the model is nonstandard and is purchased from Kingdream Public Limited Company.

A downhole motor: the outer diameter is 127 mm, the drill bit is purchased from Kingdream Public Limited Company, and the model is nonstandard.

A flexible drilling tool: 175 flexible drill string short joints are adopted, wherein each short joint is 400 mm in length and 89 mm in outer diameter and is purchased from Shanghai Keyan Energy Technology Co., Ltd., and the model is API SPEC 7.

An open hole packer: 127 mm in outer diameter and 500 mm in length, and is purchased from Sinopec Jianghan Petroleum Engineering Co., Ltd., and the model is Y211-157-120/50.

A combined acidizing tubing: an outer diameter of 88.9 mm, a pressure resistance of 100 MPa, and an N80 steel grade, which is available from Shanghai Keyan Energy Technology Co., Ltd., and is a model 3½" tubing string.

Slickwater: 0.3 wt % of guanidine gum, 0.02 wt % of pH value regulator, 0.1 wt % of bactericide and the balance of water.

Gelling acid: 20 wt % of HCl, 0.7 wt % of gelling agent, 2.0 wt % of high-temperature corrosion inhibitor, 1.0 wt % of iron ion stabilizer, 1.0 wt % of demulsifier and the balance of water.

Fracturing fluid: 0.5 wt % of guanidine gum, 0.02 wt % of pH value regulator, 1.0 wt % of demulsifier, 0.5 wt % of temperature stabilizer, 0.1 wt % of bactericide and the balance of water.

Ground crosslinking acid: 20 wt % of HCl, 0.7 wt % of thickening agent, 2.0 wt % of corrosion inhibitor, 1.0 wt % of demulsifier, 1.0 wt % of iron ion stabilizer, 0.7 wt % of cross-linking agent, 0.2 wt % of conditioner, 0.02 wt % of gel breaker and the balance of water; wherein, the cross-linking agent: LK-12 organotitanium (A): LK-12 organic titanium (B)=2:1, crosslinking ratio 0.6%.

EXAMPLE 1

FIG. 1 depicts the applicable geological context and advantages of the present embodiment. The relative position relationship of each structural component of the design case is described according to the layout mode of FIG. 2, such as: front, back, up, down, left, right, etc. The orientation description in FIG. 1 is described in terms of "north-up, south-down, left-west, right-east".

FIG. 1 illustrates the geology of the present embodiment. After the carbonate formations wellbore is drilled, the maximum horizontal principal stress direction is north-east 45 degree. Thus with conventional fracturing methods, the primary fracture propagates along the direction of maximum horizontal primary stress, i.e., north-east 45 degree and its diagonal direction. However, the oil and gas reservoir is located at south-east 30 degree and is not on the expansion path of the main fracture, which cannot be communicated using conventional fracturing methods. Therefore, the method of the invention needs to be adopted, the propagation direction of the main fracture is south-east 30 degree, and secondary complex fractures are constructed to communicate as many reservoirs as possible in the non-main stress direction.

The specific operation steps are as follows:

S1: open hole completion: carrying out open hole completion on the target fracture-vug formation, and deeply drilling a well completion section to provide space for later gravel filling so as to obtain a wellhole;

S2: determining the propagation direction and propagation length of the artificial fracture: predicting the position of a fracture-vug formation according to seismic inversion and ant body tracking modeling technologies; measuring the development characteristics of the natural fractures by means of imaging logging, core observation and the like; a refined three-dimensional crustal stress model of the whole well periphery was established to determine the distribution and magnitude of crustal stress by adopting a regional-local-single well, first large and then small, step-by-step constraint approach; then designing the propagation direction and the propagation length of the artificial fractures according to the geographical position characteristics of the target fracture-vug formation, the distribution characteristics of the holes and the natural fractures and the distribution and the size of the crustal stress, and communicating more natural fractures and holes as much as possible;

S3: put in a guide anchor: a guide anchor is lowered to the well depth of 5820 meters at the bottom of a wellhole of the open hole completion, and the direction of the guide anchor is south-east 30 degree of the wellhole; realizing side-tracking of the PDC bit in the open hole section by using a whipstock anchoring mechanism technology for open hole section sidetracking;

S4: put in drilling-fracturing integrated tool: go into the drilling-fracturing integrated tool, along the direction of entering the well, the drilling-fracturing integrated tool is from bottom to top in proper order: the system comprises a PDC bit, a downhole motor, a flexible drilling tool, an open hole packer and a combined acidizing tubing; an elastic stabilizers are connected on the combined acidizing tubing, and the drilling-fracturing integrated tool is connected with ground equipment such as a drilling machine, a slurry pump, a fracturing pump truck group and the like; the length of the artificial fractures is designed to be about 80 meters, therefore, 175 flexible drill string pups are linked to form a flexible drilling tool, and then 2 open hole packers are linked to ensure the packing reliability;

S5: directional drilling of the PDC bit: when the artificial fracture drills towards south-east 30 degree, a slurry pump pumps drilling fluid to drive an underground motor to rotate a PDC bit at a high speed, rock breaking drilling is conducted, when a tubing is 80 meters downwards, the drilled length reaches 80 meters, drilling is stopped, and an artificial fracture is obtained;

S6: sealing and fracture making: the ball is thrown to start the open hole packer to seal an annular space between the drilling tool and the artificial fractures so that the artificial fractures forms a closed space; closing a wellhead blowout preventer, and connecting a ground high-pressure pipeline and a fracturing pump truck set;

S7: sequentially pumping 50 $m^3$ slickwater (front liquid with the displacement of 3 $m^3$/min), 100 $m^3$ gelling acid (with the displacement of 5 $m^3$/min), 50 $m^3$ slickwater (with the displacement of more than 3 $m^3$/min), 460 $m^3$ fracturing fluid (with the displacement of more than 5.5 $m^3$/min), 400 $m^3$ ground crosslinking acid (with the displacement of more than 6.5 $m^3$/min) and 100 $m^3$ slickwater (displacement liquid with the displacement of more than 5.5 $m^3$/min); the injected liquid enters the closed artificial fractures through a water hole opening of the PDC bit, and a new fracture network is created through pressure build-up in the fracture to expand the range of stratum reconstruction; etching carbonate rock by using acid liquor to ensure the flow conductivity of fractures;

S8: after the liquid injection is finished, stopping pumping, measuring the pressure of the pump, and starting liquid discharge. The oil nozzle with the diameter of 10-12 mm is adopted for discharging liquid, and if the pressure drops quickly, the oil nozzle can be further enlarged for open flow. Returning residual acid to discharge all construction injection liquid by taking stratum effluent liquid and stratum fluid as standards;

S9: deblocking and withdrawing the drill bit: lifting the drilling tool to remove the sealing of the open hole packer and taking the tool out of the well.

The preferred embodiments of the invention have been described above in detail, but the invention is not limited thereto. Within the scope of the technical idea of the invention, many simple modifications can be made to the technical solution of the invention, including various technical features being combined in any other suitable way, and these simple modifications and combinations should also be regarded as the disclosure of the invention, and all fall within the scope of the invention.

The invention claimed is:

1. A method of acidizing fracturing in carbonate formations, including following steps:

(1) designing a propagation direction and a propagation length of an artificial fracture according to a target location in a fracture-vug formation and a wellbore structure after well completion, tripping a drilling-fracturing integrated tool in a wellbore, and creating the artificial fracture through drilling in the wellbore with a designed initiation location and a designed propagation azimuth;

along a direction of entering the wellbore, the drilling-fracturing integrated tool is from bottom to top in proper order and comprises: a PDC bit, a downhole motor, a flexible drilling tool, an open hole packer and a combined acidizing tubing;

along the direction of entering the wellbore, the flexible drilling tool in the drilling-fracturing integrated tool sequentially comprises a measuring short section, a weighted drill pipe short section and a common drill pipe short section from bottom to top;

(2) sealing the artificial fracture by using the open hole packer, and injecting fracturing fluid into the artificial fracture to increase pressure until initiation to create fracture network I; and (3) injecting acid for acidizing fracturing treatment on the fracture network I to create fracture network II.

2. The method according to claim 1, wherein in step (1), the PDC bit has an outer diameter of 152 mm to 171.4 mm.

3. The method according to claim 2, wherein in step (1), the downhole motor has an outer diameter of 127 mm to 139.7 mm.

4. The method according to claim 2, wherein in step (1), the combined acidizing tubing is a drilling and acidizing integrated tubing, and elastic stabilizers are connected on to the combined acidizing tubing.

5. The method according to claim 2, wherein in step (1), the method further comprises: firstly, a retrievable whip stock is tripped into the wellbore according to the wellbore structure, a depth and an orientation of the whip stock in the wellbore are determined according to the designed initiation location and the propagation direction of the artificial fracture, and then the drilling-fracturing integrated tool is tripped in to created artificial fracture.

6. The method according to claim 2, wherein in step (2), the pressure increases to initiate the fracture network I so that the number of fractures in fracture network I is ≥3.

7. The method according to claim 1, wherein in step (1), the downhole motor has an outer diameter of 127 mm to 139.7 mm.

8. The method according to claim 7, wherein in step (1), the combined acidizing tubing is a drilling and acidizing integrated tubing, and elastic stabilizers are connected on to the combined acidizing tubing.

9. The method according to claim 7, wherein in step (1), the method further comprises: firstly, a retrievable whip stock is tripped into the wellbore according to the wellbore structure, a depth and an orientation of the whip stock in the wellbore are determined according to the designed initiation location and the propagation direction of the artificial fracture, and then the drilling-fracturing integrated tool is tripped in to created artificial fracture.

10. The method according to claim 1, wherein in step (1), the combined acidizing tubing is a drilling and acidizing integrated tubing, and elastic stabilizers are connected on to the combined acidizing tubing.

11. The method according to claim 1, wherein in step (1), the method further comprises: firstly, a retrievable whip stock is tripped into the wellbore according to the wellbore structure, a depth and an orientation of the whip stock in the wellbore are determined according to the designed initiation location and the propagation direction of the artificial fracture, and then the drilling-fracturing integrated tool is tripped in to created artificial fracture.

12. The method according to claim 1, wherein in step (2), the pressure increases to initiate the fracture network I so that the number of fractures in fracture network I is ≥3.

13. The method according to claim 12, wherein in the step (3), an osmotic flow of acid in porous media of formations by alternately injecting with the acid and the fracturing fluid.

14. The method according to claim 13, wherein in step (3), a number of the alternating injections is 3 to 5.

15. The method according to claim 1, wherein in the step (3), an osmotic flow of acid in porous media of formations by alternately injecting with the acid and the fracturing fluid.

16. A process for oil and gas field exploitation, comprising the method of claim 1.

* * * * *